US005890240A

United States Patent [19]

Graham

[11] Patent Number: 5,890,240

[45] **Date of Patent: *Apr. 6, 1999**

[54] SHEET ROLL UP

[76] Inventor: Wayne B. Graham, 2571 Highland Hills Dr., El Dorado Hills, Calif. 95630

[ * ] Notice: The term of this patent shall not extend beyond the expiration date of Pat. No. 5,533,214.

[21] Appl. No.: 680,514

[22] Filed: Jul. 9, 1996

Related U.S. Application Data

[63] Continuation-in-part of Ser. No. 350,382, Dec. 5, 1994, Pat. No. 5,533,214, which is a continuation-in-part of Ser. No. 825,820, Jan. 24, 1992, abandoned, which is a continuation-in-part of Ser. No. 518,960, May 4, 1990, abandoned.

[51] Int. Cl.[6] ..... E04H 4/10

[52] U.S. Cl. ..... 4/502; 185/7; 185/33; 160/243; 160/310

[58] Field of Search ..... 4/498, 500, 502; 242/390.8, 399, 403, 403.1, 919; 180/10, 21; 446/458; 160/243; 185/7, 33

[56] References Cited

U.S. PATENT DOCUMENTS

| | | | |
|---|---|---|---|
| 2,909,145 | 10/1959 | De Hertelendy | 180/21 |
| 2,977,714 | 4/1961 | Gibson | 446/458 |
| 3,070,811 | 1/1963 | Bender | 4/502 |
| 3,693,695 | 9/1972 | Deane | 160/243 |
| 3,782,663 | 1/1974 | Stevenson | 242/918 |
| 3,885,255 | 5/1975 | Vorbach et al. | 4/502 |
| 4,310,987 | 1/1982 | Chieffo | 446/458 |
| 4,501,569 | 2/1985 | Clark, Jr. et al. | 446/458 |
| 5,533,214 | 7/1996 | Graham | 4/502 |

*Primary Examiner*—Robert M. Fetsuga
*Attorney, Agent, or Firm*—Joseph Smith

[57] ABSTRACT

A drum for rolling up and unrolling protective covers has a driven pendulum within for applying a rotary moment to cause the drum to roll. The pendulum is powered in one rotary direction or the other by an electrical motor according to a signal from outside the drum, and battery packs are enclosed with the drive elements to provide a power source. A sealed drum is provided to float in swimming pools. In another embodiment, a common electric drill is used for the drive mechanism.

14 Claims, 8 Drawing Sheets

SHEET ROLL UP

CROSS REFERENCE TO RELATED APPLICATIONS

This is a continuation-in-part of application Ser. No. 08/350,382, filed Dec. 5, 1994, now issued as U.S. Pat. No. 5,533,214; which is a continuation-in-part of application Ser. No. 07/825,820 filed Jan. 24, 1992, now abandoned; which is a continuation-in-part of application Ser. No. 07/518,960, filed May 4, 1990, now abandoned.

FIELD OF THE INVENTION

The present invention is in the area of devices for rolling up and unrolling two dimensional sheets such as protective covers, and is particularly applicable to rolling and unrolling swimming pool covers.

BACKGROUND OF THE INVENTION

It is well known in the art to extend and retract protective covers, such as covers over swimming pools, with motor driven devices; and several United States Patents have issued for such devices. A good example of a device applied to swimming pools is the device taught by U.S. Pat. No. 4,811,433 issued to inventor Scott H. MacDonald et al on Mar. 14, 1989. The MacDonald invention includes, among other elements, a drum for rolling up a swimming pool cover, cables attached to the cover and passing through pulleys and guides for extending the cover, motor driven mechanism for driving the drum to roll up the cover and for driving reels to wrap the cables for extending the cover, and a special floppy clutch to cause the drive mechanism to engage the drum or the cable reels as needed to extend or roll up the cover. The drum and drive mechanism are housed in a recessed pit at one end of the pool, and there are guides and pulleys attached to the swimming pool structure to facilitate the operations. The device taught by MacDonald is typical of devices for rolling up and extending swimming pool covers.

A significant problem with the MacDonald invention and other known devices of the same nature is that the devices are quite complicated, and therefore expensive, and are relatively unreliable and subject to frequent adjustment and repair by reason of their complicated nature. Moreover, the drive and all associated mechanisms are permanent installations at the pool, and are continuously exposed to the pool water and chemicals, such as chlorine and acid, used in most swimming pools. This exposure creates further deterioration and maintenance problems.

Another problem with devices like the MacDonald device, is that the pool and surrounding area must be either originally designed and built to accommodate the cover and operating device, or must be extensively altered to accommodate such a device at a later date. A significant example of this expensive requirement is the enclosure pit formed into the pool deck at one end to accommodate the drive, floppy clutch, drum, and associated elements, such as taught in the MacDonald patent described above. Most such devices require a housing of similar nature for the various components. The storage pit, drive, pulleys, and guides associated with such a device are certainly cumbersome, and might well be clumsy or even dangerous for swimmers.

Yet another difficulty is in the stationary nature of the drum and driving elements, which dictates that the cover has to be translated across the pool in some manner to be wrapped on the drum, or extended from the drum. If the drive were to translate, providing a roll up action without dragging friction, less power would be required.

What is clearly needed is a device for rolling up and unrolling protective covers over areas needing such protection, such as swimming pools or sports playing fields, with completely enclosed and translatable drive, so that the drum translates to roll up and unroll the cover, and the drive and associated mechanisms are enclosed in the drum. Such a device would be less expensive than conventional devices, both in manufacture and installation, and would be more durable in operation. Moreover, such a device would not present inconvenience or hazard to users of the pool or other area so protected, and could be conveniently stored away from the active area when not in use. Such a device could also be applied to any existing area or pool without alteration to the existing structure, and would therefore have broad application.

SUMMARY OF THE INVENTION

A powered drum for rolling up and unrolling a substantially two dimensional sheet that forms a cover is provided in a preferred embodiment having a substantially cylindrical outer enclosure. A pendulum weight is mounted rotationally within the outer enclosure to rotate in a plane substantially orthogonal to the axis of the drum. The pendulum is driven in either rotary direction by an enclosed drive to apply a rotational moment to the drum to cause the drum to roll.

In a preferred embodiment the outer enclosure is sealed to be watertight to allow the drum to float in a pool for rolling and unrolling a swimming pool cover. In the preferred mode the powered drum has battery packs on board that are rechargeable via a connector through a wall of the enclosure, and the drive may be activated in either rotary direction by means of radio signals from outside the enclosure. In one mode, a level switch may be used to prevent the pendulum weight from going over the top of the rotary mountings, which would reverse the direction of the drive.

The drum, powered from within, accomplishes the task of rolling and unrolling a cover while itself translating across whatever area the a cover is meant to protect, and doesn't drag the cover across the area. This action causes less wear to the cover and requires less power than conventional methods. The powered, rolling drum is less complicated and expensive than most other methods of accomplishing the purpose, and all drive elements are enclosed, providing protection to increase reliability and longevity. The powered drum can be applied to most areas requiring protection, such as pools, without requiring guides, pits, pulleys, cables and the like to be installed.

In yet another embodiment, a detachable external drive system is used roll and unroll the two-dimensional sheet.

DESCRIPTION OF THE PREFERRED EMBODIMENTS

Figure 1:
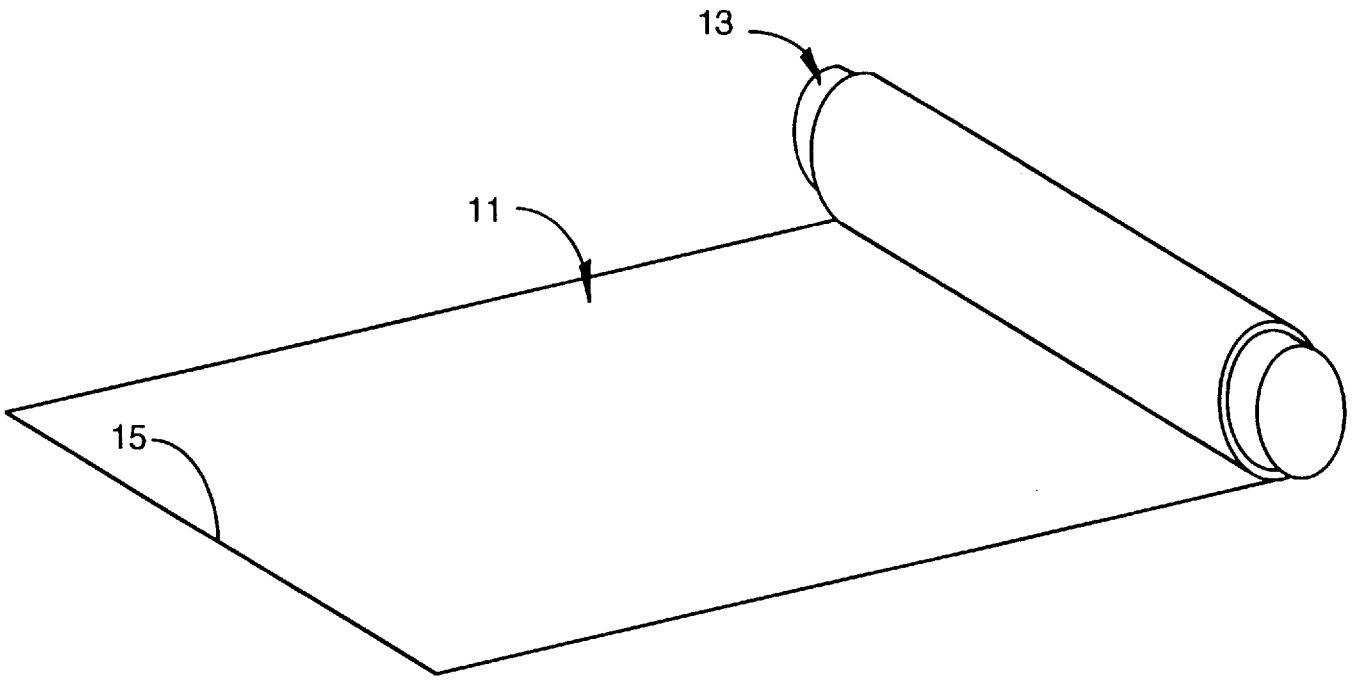
FIG. 1 is a perspective view of a drum according to a preferred embodiment, showing a cover partially rolled on the drum.

FIG. 1 shows a device according to a preferred embodiment of the present invention. A cover 11 is partially flat on a surface and partially rolled on a drum 13. Drum 13 is configured in the preferred embodiment to allow cover 11, which is substantially a two dimensional sheet, to be fastened to the drum at one end, and encloses drive mechanisms entirely within the diameter and length of the drum that, when activated, cause the drum to roll. These mechanisms are not shown in FIG. 1. If the drum is activated to roll counterclockwise, to the left in FIG. 1, the drum will translate and roll up the cover. If the drum is activated to roll clockwise, to the right in FIG. 1, the drum will translate and unroll the cover. The cover will not be forced to drag over any surface that it rests upon. For example, if the cover is covering a portion of an athletic field, the cover will be simply rolled up or unrolled, it will not be forced to drag across the surface of the athletic field, as would be the case if the drum were fixed to a frame anchored to the field. The result is less wear on the cover and less power to operate than would otherwise be the case.

Drum 13, self-translatable, is useful for covering and uncovering both solid surfaces and water areas. In the case of use for swimming pool covers, the drum can be sealed at both ends and made to be water tight, so the drum will float on water, or it can be made to ride on the edges of the pool. In combination with a floatable cover material the drum may reside in the pool itself, and will move across the water as it rolls up or unrols the pool cover. In either case, it will be helpful, but not essential, if end 15 of the cover parallel to the drum, but furthest from the drum in the unrolled condition, is anchored, at least temporarily, to some solid structure while the drum is in operation. Without such an anchor, the drum is still useful, but may pull the cover toward the drum instead of rolling up as may be desired. Alternatively, the drum may be temporarily anchored so the cover translates.

Figure 6B:
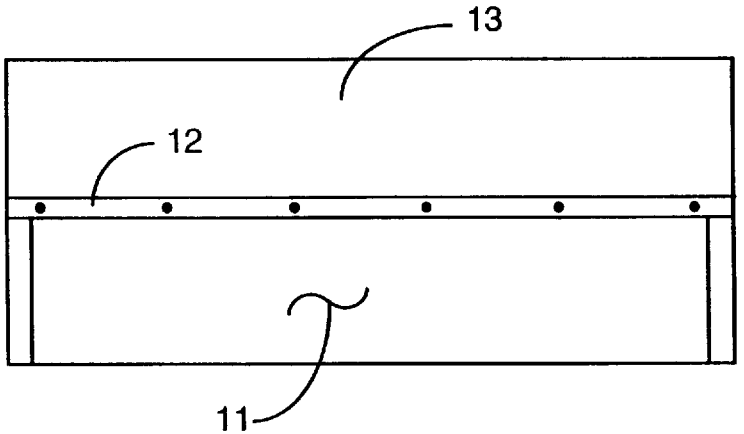
FIG. 6B is a lateral view of the apparatus with a sheet attached showing a full lateral view of a means for attachment of the sheet.
Figure 6C:
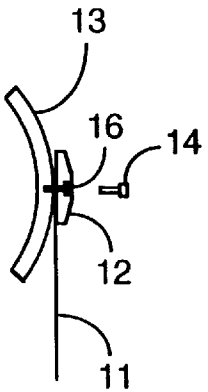
FIG. 6C shows a close-up, expanded, cross-sectional view of a means for attaching the sheet.
Figure 6A:
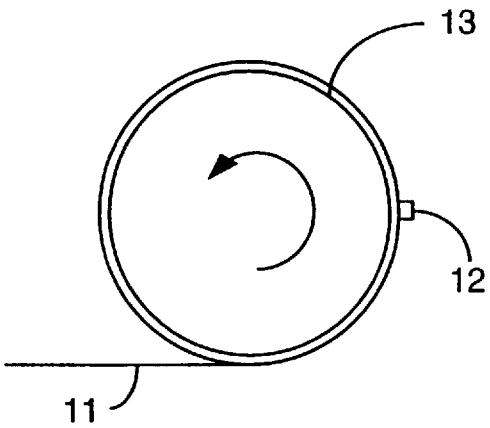
FIG. 6A shows an end view of the preferred embodiment illustrating how a sheet would be rolled up using the device and a means for attaching the sheet to the device.

FIGS. 6A, 6B, and 6C, illustrate the attachment of the cover 11 to the drum 13. As a simple example of one way to accomplish this task, a strip 12 running the length of the drum can be used to secure the cover to the drum. In this example, the strip has a plurality of holes, such as hole 16, by which the strip can be attached to the drum via screws, such as screw 14. In the preferred mode, the cover is also penetrated by the screws, so that the cover is held in place both by the screws as well as by static friction from the strip. Of course there are many ways in which the cover could be held in place. For example, the cover could be glued to the drum, or it could even be wrapped fully around the drum and attached to itself.

Figure 2:
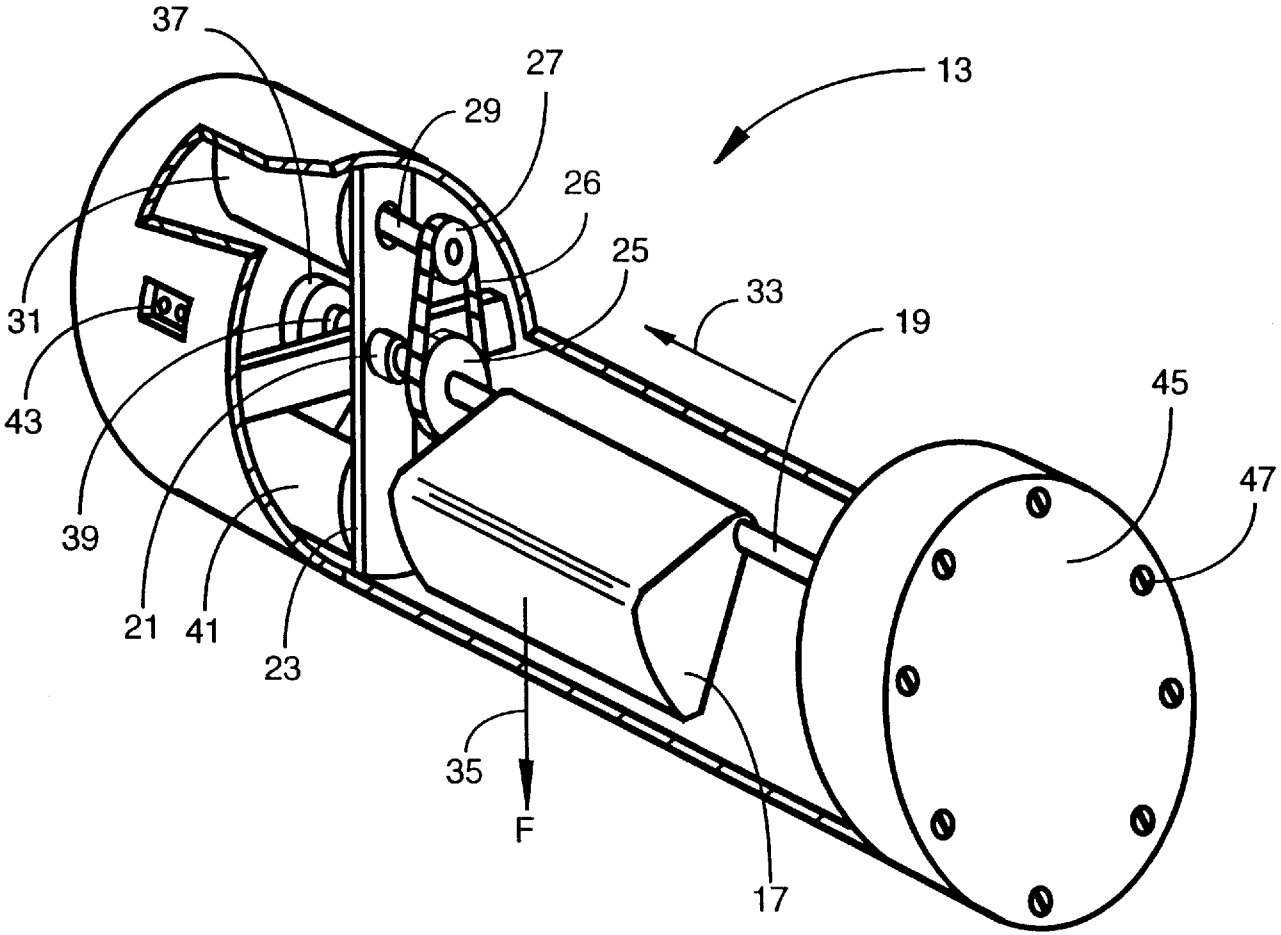
FIG. 2 is a perspective and partially cut away view of a drum according to a preferred embodiment, showing internal elements for propelling the drum.

FIG. 2 is a partially cut away view of drum 13, showing internal elements for control and drive. A pendulum weight 17 is suspended from and fixedly attached to a swing shaft 19. The swing shaft is positioned preferably along the central axis of drum 13, and is rotatably attached at one end by a bearing 21 supported in a frame assembly 23. In FIG. 2 frame assembly 23 is two crossed members fastened together at about 90 degrees and attached to the inside of the outer wall of drum 13. The frame member could be a disk, or any of several other suitable forms adapted to mounting the other elements.

The opposite end of swing shaft 19 from bearing 21 is rotatably mounted in another bearing (not shown) supported in a second frame member (also not shown) inside drum 13. In the preferred mode, a gear belt pulley 25 is fixedly attached to swing shaft 19 and connected by a gear belt 26 to another gear belt pulley 27 mounted on output shaft 29 of an electric motor 31. Motor 31 is mounted to frame member 23. The drive arrangement is such that activating motor 31 in one rotary direction causes swing shaft 19 to rotate relative to the drum and causes pendulum 17 to swing to one side of shaft 19. In FIG. 2 pendulum 17 is shown offset to one side as a result of operation of motor 31 clockwise relative to viewing direction 33.

Motor 31 in the preferred embodiment is a direct current motor with a geared drive integrally mounted on the front of the motor. Such motors are common in the art and available from several manufacturers.

In the offset position shown in FIG. 2 the weight of pendulum 17 causes a force F to be applied on a line of action through the center of gravity of the pendulum weight to one side of shaft 19, which applies a rotary moment to shaft 19, hence to drum 13, urging drum 13 to roll in the direction to the same side of shaft 19 that force F is applied. In the case of FIG. 2, the drum is urged to roll counterclockwise relative to viewing direction 33. In FIG. 1 this action would cause the cover to be wound onto the drum.

The drive need not be a gear belt drive as shown in FIG. 2, but could be, for example, by mating gears or by sprockets with a connecting chain, among other possibilities. Also, the pendulum weight could take many other shapes not shown.

When pendulum 17 is directly below swing shaft 19 the line of action of force F is directly through the swing shaft and there is no rotary moment applied to the drum. This is henceforth known as the rest position for the pendulum weight. The maximum moment in operation is at the position that the pendulum weight is rotated 90 degrees from the rest position (in either direction), for at this position the length of the moment arm between the line of action of force F and the centerline of shaft 19 is maximum.

If drum 13 is restrained from rolling while the motor is operated, or rolls more slowly rotationally than the pendulum weight is rotated, the pendulum weight will pass through the 90 degree position and eventually reach a position where the pendulum is directly above shaft 19, 180 degrees from the rest position, and the line of action of force F again passes through the centerline of shaft 19. Any rotation in the same direction beyond this point will cause the line of action of force F to shift to the other side of shaft 19, urging the drum to roll in the opposite direction. Those skilled in the art will appreciate that the line of action of the force F will only continue to urge the drum in this opposite direction until the pendulum weight is again at the bottom of its rotation, at which time it will urge the drum in the original direction again. This situation may be desirable as a safety device in the event the rolling drum strikes an immoveable object, because it will reverse the direction of the moment applied to the drum.

If, however, it is desired to prevent the pendulum weight 17 from passing over the top of shaft 19 as described above, a level switch 37, as illustrated in FIG. 2, may be attached to shaft 19. Level switch 37 rotates with pendulum weight 17 and has an electrical contact that is set to remain closed at all angular positions of pendulum 17 except where the pendulum is approximately above shaft 19. In the preferred mode, the range of angular positions of the pendulum weight, when the contact of level switch 37 is closed, is about 135 degrees in each direction from the rest position.

Because the level switch is attached to shaft 19 and in operation drum 13 must rotate several times to roll up or unroll a cover, the level switch is wired to electrical control wiring inside the drum in the preferred embodiment through a commutator ring 39 with appropriate contacts or tracks. The commutator ring is an item available commercially in several forms, and allows the motor and electrical controls to rotate with drum 13 while the level switch rotates only with shaft 19.

The motor drive and controls are powered in drum 13 by battery packs also mounted within the drum. A battery pack 41 is shown mounted to frame assembly 23 on the opposite side of motor 31, and the battery pack is made and placed to counterbalance the motor. Two other battery packs (not shown) are mounted to a frame assembly (not shown) similar to frame assembly 23 at the end of drum 13 opposite frame assembly 23, to further contribute to equal and balanced weight distribution relative to the axis of shaft 19, and also relative to the drum from end to end. Internal components are placed in the preferred embodiment for balance so that the driven pendulum weight is the only element to contribute to an unbalanced moment. In one preferred mode, the motor and/or the battery packs may in fact comprise the pendulum mass for further efficiency. (See discussion of FIG. 3C for such an alternative embodiment.)

The battery packs are rechargeable battery packs, and are connected in the overall assembly to a connector 43 through a wall of the drum in a manner that an outside power source may be connected as needed to recharge the internal battery packs. In a preferred embodiment the ends of the drum, such as end 45 in FIG. 2, are removable and sealed with gaskets (not shown) to be watertight. End 45 is held in place by fasteners such as fastener 47, and the other end of the drum is similarly sealed and fastened in place. In some embodiments it is not necessary that the drum be sealed, but in the preferred mode, sealing accomplishes protection from water when the drum is used for pool covers, and protection from dirt, dust, and other foreign matter in all environments. The drum outer wall and ends are made of aluminum in the preferred embodiment, but may be made of other material, such as plastic or even stainless steel.

Figure 3A:
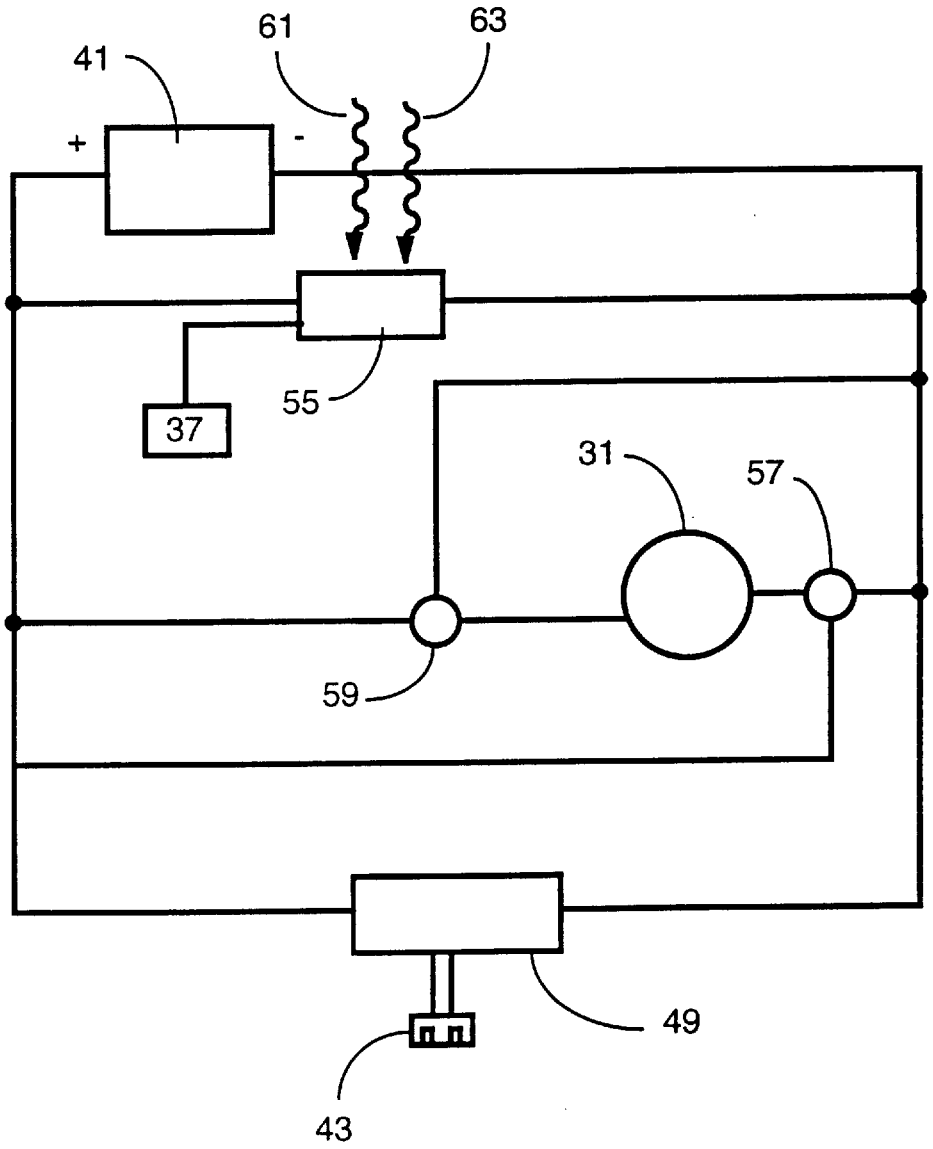
FIG. 3A is a block diagram of an electrical wiring arrangement for a drum drive according to a preferred embodiment.

FIG. 2 shows several of the main elements of the self-translating drum in the preferred embodiment. Some elements are not shown, such as conventional wiring harnesses and some electrical components. FIG. 3A is a block diagram of a wiring and control system for the self-translating drum in a preferred embodiment. Battery 41 represents all of the battery packs in the electrical system wired in parallel. Several battery packs are used in the preferred embodiment so the weight of the batteries and the motor can be balanced relative to the length of the drum and the axis of the swing shaft in the drum.

A radio control box 55 is activated in the preferred embodiment by a radio signal represented by signal 61 to activate solenoid 57 which drives motor 31 in one direction. A radio signal 63 on a different frequency activates a second solenoid 59 which drives motor 31 in the opposite direction. In the preferred embodiment, signals 61 and 63 are sent from outside the drum by a control box not shown for signalling the drum to drive in the desired direction.

Level switch 37 stops the drive when the swing shaft is rotated by more than 135 degrees from the rest position. In one preferred embodiment, a control box 49 converts alternating current connected at connector 43 to direct current for recharging the battery packs as required. Alternatively, in another preferred embodiment, the system could be recharged using a low voltage transformer external to the apparatus.

Figure 3B:
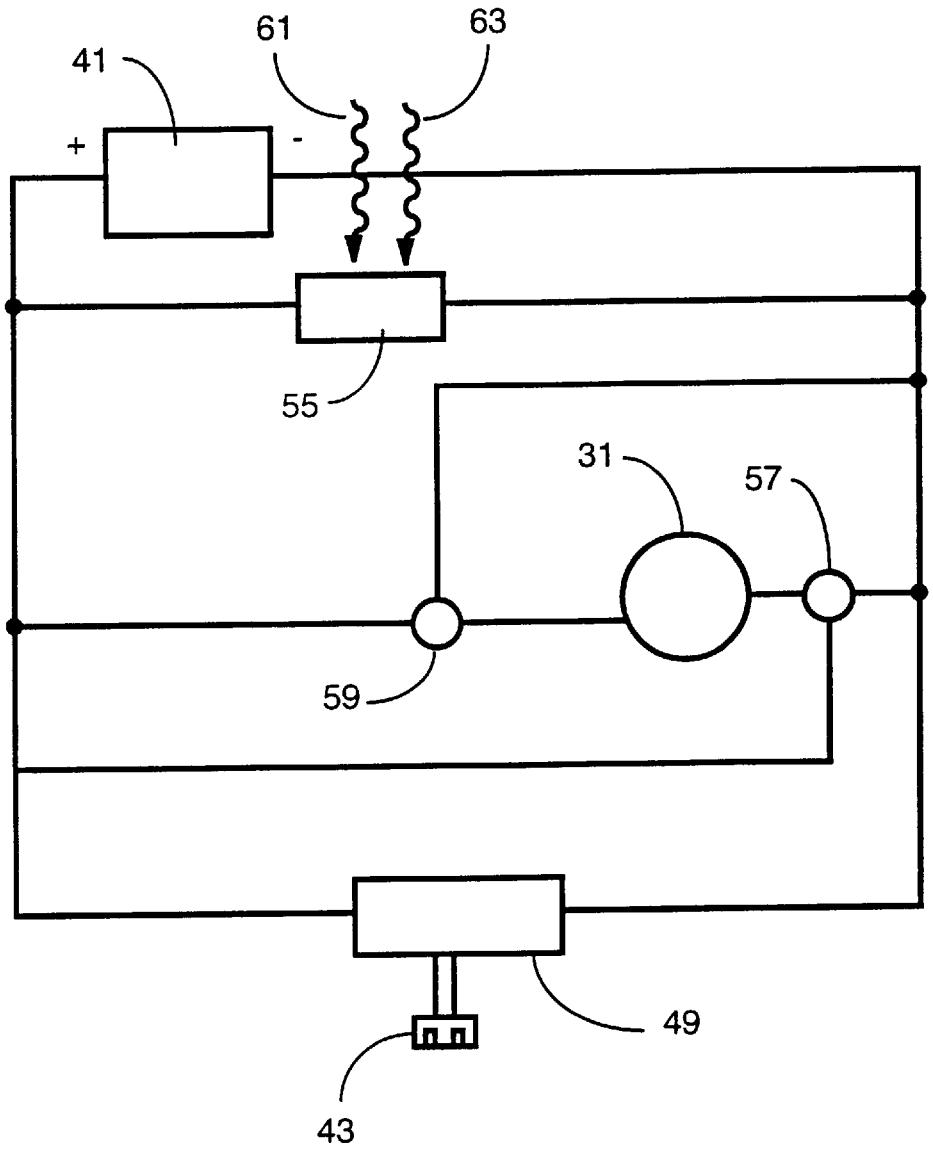
FIG. 3B is a block diagram of an alternative electrical wiring arrangement for a drum drive according to a preferred embodiment.
Figure 3C:
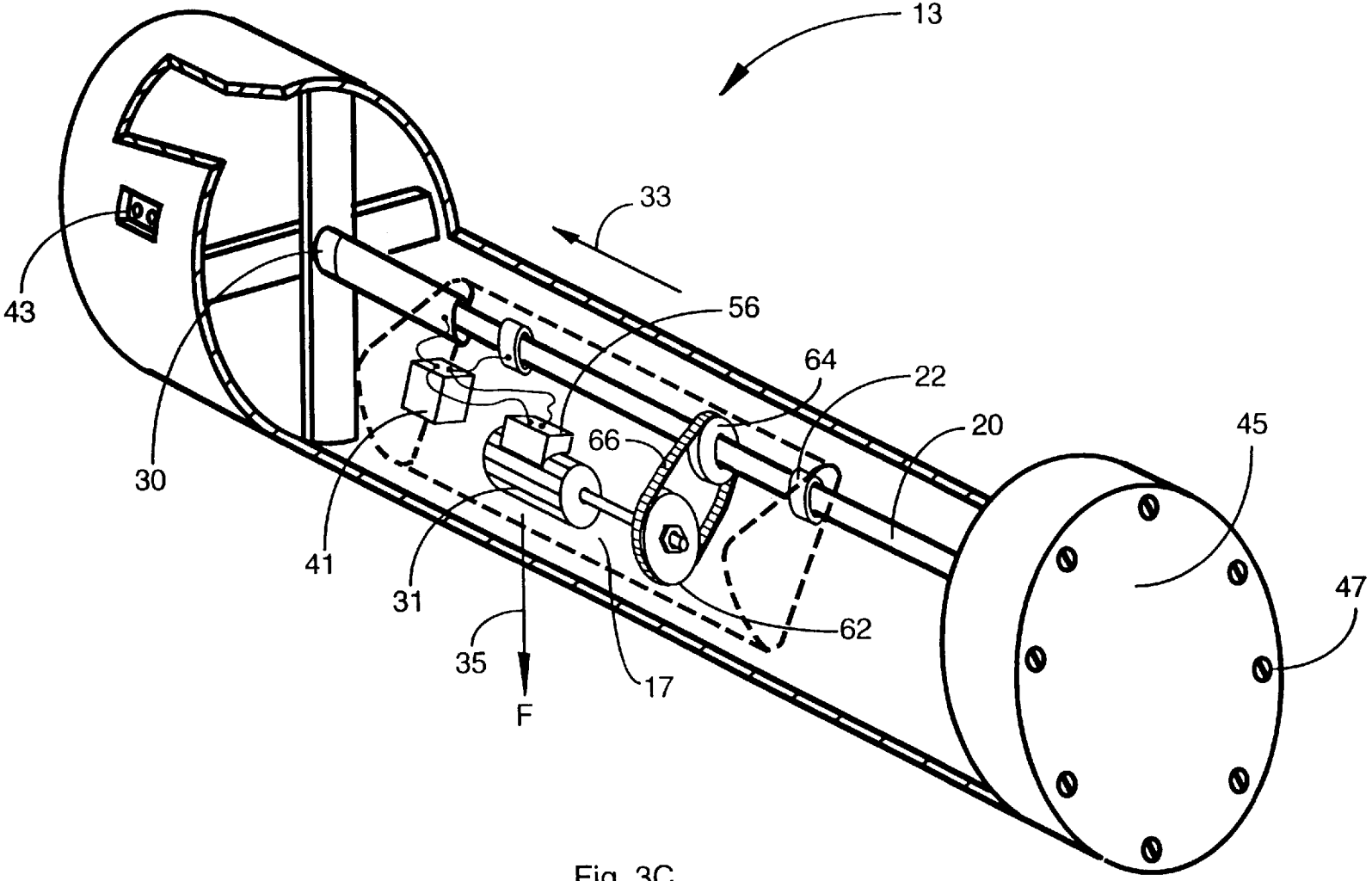
FIG. 3C is a perspective and partially cut away view of a drum according to a preferred embodiment, showing internal elements that could be used to make up a pendulum weight that also drive the drum.

There are a number of equivalent wiring systems that might be used to power the self-propelled drum. Also, as illustrated in FIG. 3B, the level switch could be eliminated as a safety precaution as discussed earlier. In another preferred embodiment illustrated in FIG. 3C, pendulum 17 (shown dotted) is attached to a swing shaft 30, so that the pendulum is rotatable about the central axis of the drum via swing shaft 30. The swing shaft 30 is rotatably attached to the framework of the drum by means conventional in the art. In this embodiment, the pendulum contains the battery 41, the drive motor 31 and a control electronics package 56, which is equivalent to the control box 55 in combination with solenoids 59 and 57. In this embodiment, battery 41 is recharged via connector 43 by means of appropriate feedthroughs and rotating contacts connected to shaft 20, which is fixed relative to the drum. Power from motor 31 is transmitted to shaft 20 by means of pulleys 62 and 64 and belt 66. The end of the pendulum 17 opposite swing shaft 30 may be supported via fixed shaft 20, for example, by means of a bearing and feedthrough 22; or by having a loose hole in the pendulum; or it can be supported in a cantilever approach by means of swing shaft 30 without contacting fixed shaft 20. In other alternative embodiments the pendulum might include the battery, for example, without the motor, or vice versa.

Figure 4:
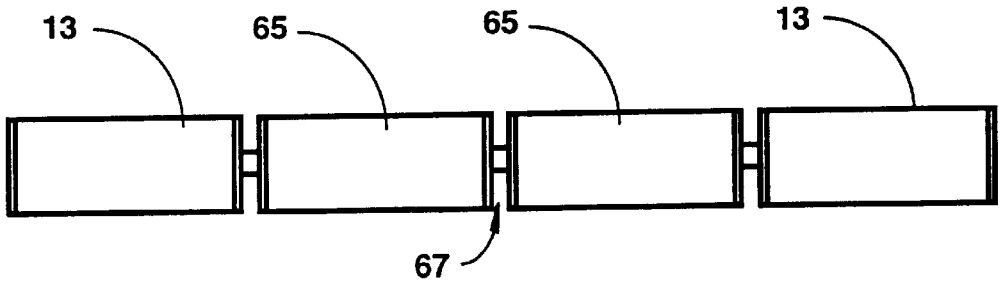
FIG. 4 is an elevation view of a drum assembly made up of powered and non-powered drums, connected by spools.

FIG. 4 shows an assembly of self-powered drums 13 and unpowered empty drums 65 that may be used to provide a long drum assembly for such applications as rolling up and unrolling covers on large areas, such as baseball fields. Powered drums and unpowered drums may be assembled in different configurations to control the rolling potential of a drum assembly and to provide needed length. The drums can be assembled together in any needed order using spool pieces such as spool piece 67 that are configured to bolt to the ends of each of two different drums, joining the drums in a line. In applications requiring that the drums be watertight, threaded openings for connecting drums do not pass through the walls or ends of a drum.

Figure 5:
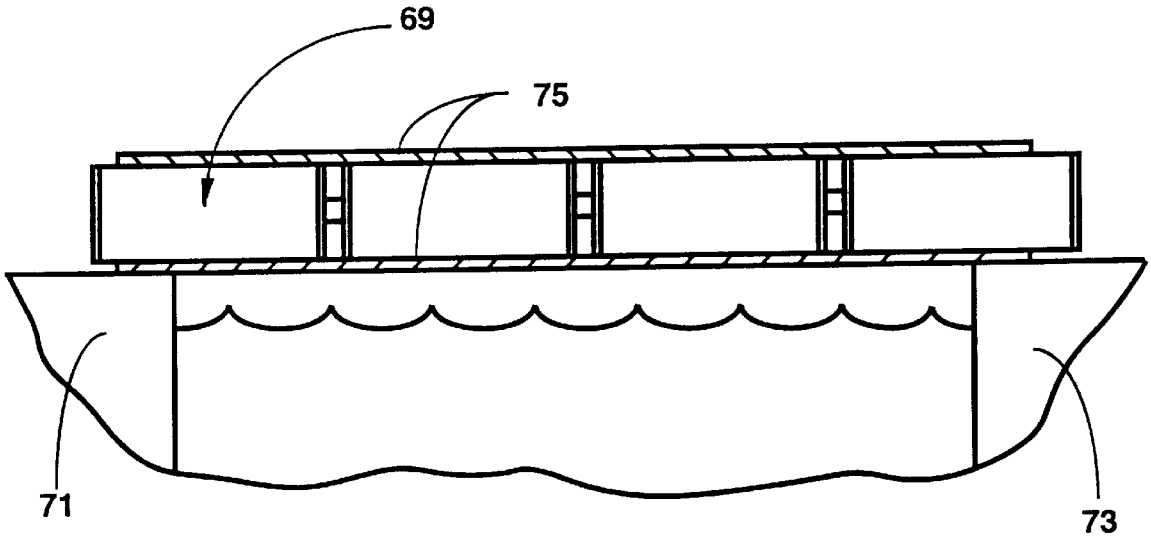
FIG. 5 is a section view showing an application of a powered drum assembly relative to a swimming pool.

FIG. 5 is a section view through a pool showing how a drum assembly 69 may be used to span a pool and roll up and unroll a cover without residing in the water. Drum assembly 69 is assembled to be wider than the width between sides 71 and 73 of the pool, and cover 75 shown partially wrapped on drum assembly 69 is also wider than the width of the pool. In this application, a swimming pool cover can be extended and rolled up, and it is not necessary that the drum assembly float in the pool.

Figure 7:
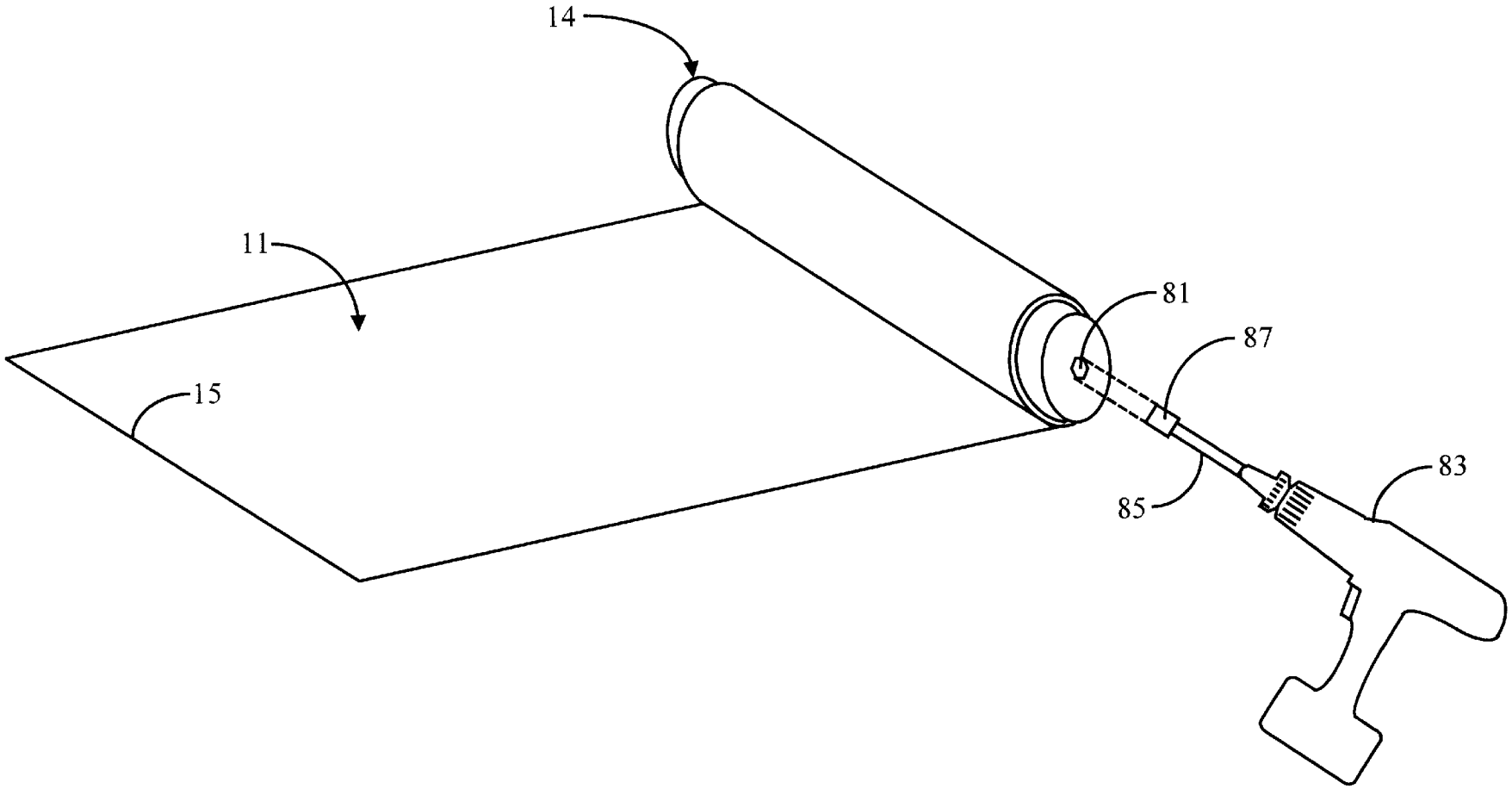
FIG. 7 shows yet another embodiment of the invention which uses an external drive system.

FIG. 7 shows another embodiment of a two dimensional sheet roll up which does not use an internal drive. In this embodiment, cover 11 is attached to a drum 14 as in the previous embodiments. However, in this embodiment, the drum has an attachment element 81 on one end, which is concentric with the axis of rotation of the drum and fixedly attached to the drum at one end. An extension 85 with a mating element 87 for mating with attachment element 81, can be fitted to the chuck of a common electric drill 83 and the drill can be used to provide the torque necessary to turn the drum, one way to roll up the sheet and the other way to unroll the sheet. In the preferred mode, a nut is used for the attachment element 81, and a socket is used for the mating element 87, and a common flexible extension such as that used with a socket set is used for extension element 81. Those skilled in the art will appreciate that there are many other configurations for the attachment element 81 and mating element 87. For example, one could attach a socket to said drum end and the end of extension 87 would already have the proper mating shape. Also, one could some specialized shape other that a nut. Also many different types drilled could be used, but preferrably a battery powered drill would be useful around pool water. Also, those skilled in the art will appreciate that if the sheet is a pool cover, that the drum should be watertight.

One of ordinary skill in the art will recognize that there are many alterations that may be made to the invention as shown in the preferred embodiments without departing significantly from the spirit and scope of the invention. For example, drums may be made of relatively small diameter, such as six inches, or much larger diameter, such as three feet or more. Generally, a larger diameter is preferable to allow for a relatively heavy pendulum weight to provide driving moment, but there are practical limitations to the size based on application. In like manner, drums may be made of various materials and to various lengths. Also, there are many shapes that might be imparted to the pendulum and to other elements of the device. All such differences should be regarded as design changes within the spirit and scope of the invention.

What is claimed is:

1. A powered drum assembly for rolling up a substantially two dimensional sheet, said sheet being in contact with a substantially horizontal two dimensional surface, comprising:

cylindrical frame means having an axis of rotation for rolling up said sheet on said frame means;

a swing shaft rotatably mounted within said cylindrical frame means along said axis;

pendulum means located within said cylindrical frame means and connected to said swing shaft such that said pendulum means can rotate in a plane substantially orthogonal to said axis of said cylindrical frame means, said pendulum means for providing a mass for rotation not located on said axis;

drive means, self-contained by said powered drum assembly, connected to said pendulum means for rotating said pendulum means, said pendulum means when rotated causing a rotational moment to be applied to said cylindrical frame means due to the influence of gravity acting on said pendulum means; and attachment means for attaching said two dimensional sheet to said frame means; and wherein when said cylindrical frame means rolls up said sheet, said frame means rolls horizontally on said sheet along said two dimensional surface.

2. A powered drum assembly as in claim 1 wherein said cylindrical frame means is sealed watertight to form a cylindrical enclosure that will float in a swimming pool for rolling up said sheet, said sheet being a swimming pool cover.

3. A powered drum assembly as in claim 1 wherein said drive means comprises:

an electric motor mounted inside said cylindrical frame means for providing rotational power for said drive means, said electric motor having an output shaft;

transmission means connected to both said output shaft and to said pendulum means for causing said pendulum means to rotate; and storage battery means wired to said motor for providing electrical current to operate said drive means.

4. A powered drum assembly as in claim 3 wherein said transmission means comprises a first gear belt pulley mounted on said output shaft, a second gear belt pulley mounted on said pendulum means, and a gear belt engaging said first and said second gear belt pulleys.

5. A powered drum assembly as in claim 1 wherein said drive means comprises wiring and control means for controlling said electric motor, said wiring and control means comprising a controlled switch responsive to a first signal from outside said cylindrical frame means for causing said drive means to rotate said pendulum means in one rotary direction, said radio controlled switch responsive to a second signal from outside said cylindrical enclosure for causing said drive means to rotate said pendulum means in the other rotary direction.

6. A powered drum assembly as in claim 5 wherein said wiring and control means comprises a direction sensitive level switch mounted to said pendulum means, said level switch having an electrical contact for connecting electrical power to said drive means, such that said contact remains closed at all positions of said pendulum means from rest position to 90 degrees from rest position in either rotary direction.

7. A powered drum assembly as in claim 1 further comprising:

a non-powered drum of substantially the same diameter as said cylindrical frame means, said non-powered drum attached to one end of said cylindrical frame means, said non-powered drum mounted to also rotate about said axis.

8. A powered drum assembly for rolling up a substantially two dimensional sheet, comprising:

a cylindrical frame having an axis of rotation for rolling up said sheet on said frame means;

a swing shaft rotatably mounted within said cylindrical frame along said axis;

a pendulum located within said cylindrical frame and connected to said swing shaft such that said pendulum can rotate in a plane substantially orthogonal to said axis of said cylindrical frame, said pendulum for providing a mass for rotation not located on said axis;

a drive system, self-contained by said powered drum assembly, connected to said pendulum for rotating said pendulum, said pendulum when rotated causing a rotational moment to be applied to said cylindrical frame due to the influence of gravity acting on said pendulum; and attachment means for attaching said two dimensional sheet to said cylindrical frame.

9. A powered drum assembly as in claim 8 wherein said cylindrical frame is sealed watertight to form a cylindrical enclosure that will float in a swimming pool for rolling up said sheet, said sheet being a swimming pool cover.

10. A powered drum assembly as in claim 8 wherein said drive system comprises:

an electric motor mounted inside said cylindrical, said electric motor having an output shaft;

a power transmission element connected to both said output shaft and to said pendulum for causing said pendulum to rotate; and a storage battery wired to said motor for providing electrical current to operate said drive system.

11. A powered drum assembly as in claim 10 wherein said transmission element comprises a first gear belt pulley mounted on said output shaft, a second gear belt pulley mounted on said pendulum, and a gear belt engaging said first and said second gear belt pulleys.

12. A powered drum as in claim 8 wherein said drives system comprises a control system for controlling said electric motor, said control system comprising a controlled switch responsive to a first signal from outside said cylindrical frame for causing said drive system to rotate said pendulum in one rotary direction, said radio controlled switch responsive to a second signal from outside said cylindrical enclosure for causing said drive system to rotate said pendulum in the other rotary direction.

13. A powered drum assembly as in claim 12 wherein said control system comprises a direction sensitive level switch mounted to said pendulum, said level switch having an electrical contact for connecting electrical power to said drive system, such that said contact remains closed at all positions of said pendulum from rest position to 90 degrees from rest position in either rotary direction.

14. A powered drum assembly as in claim 8 further comprising:

a non-powered drum of substantially the same diameter as said cylindrical frame, said non-powered drum attached to one end of said cylindrical frame, said non-powered drum mounted to also rotate about said axis.

* * * * *